US007012947B2

(12) United States Patent
Johansson

(10) Patent No.: US 7,012,947 B2
(45) Date of Patent: Mar. 14, 2006

(54) ARRANGEMENT FOR FASTENING HEATING ELEMENTS TO A FURNACE

(75) Inventor: Lars-Göran Johansson, Hallstahammar (SE)

(73) Assignee: Sandvik AB, Sandviken (SE)

( * ) Notice: Subject to any disclaimer, the term of this patent is extended or adjusted under 35 U.S.C. 154(b) by 16 days.

(21) Appl. No.: 10/500,174

(22) PCT Filed: Dec. 18, 2002

(86) PCT No.: PCT/SE02/02375

§ 371 (c)(1),
(2), (4) Date: Jan. 24, 2005

(87) PCT Pub. No.: WO03/056877

PCT Pub. Date: Jul. 10, 2003

(65) Prior Publication Data

US 2005/0129085 A1 Jun. 16, 2005

(30) Foreign Application Priority Data

Dec. 28, 2001 (SE) ..... 0104453

(51) Int. Cl.
*H05B 3/00* (2006.01)
*H05B 3/62* (2006.01)

(52) U.S. Cl. ..... 373/118; 373/109

(58) Field of Classification Search ..... 373/109–111, 373/117–119, 127–134; 219/388, 390
See application file for complete search history.

(56) References Cited

U.S. PATENT DOCUMENTS 1,839,613 A 1/1932 Swoboda et al. ..... 219/388
4,394,566 A * 7/1983 Magnusson ..... 373/128

FOREIGN PATENT DOCUMENTS

FR 1393081 2/1965

* cited by examiner

*Primary Examiner*—Tu Hoang
(74) *Attorney, Agent, or Firm*—Alfred J. Mangels

(57) ABSTRACT

The invention relates to an arrangement for mounting electric heating elements in a furnace in which objects are intended to be heated, wherein the furnace wall includes a furnace insulation (4) comprised of high grade brick, and wherein the heating zones (6) of respective electric heating elements (2) are placed vertically and parallel with the inner surface of the furnace wall in operation. The invention is characterized in that the electric leads or conductors (7, 8) of each element (2) are mounted in a cassette (9) and extend in channels (10, 11) therein; in that the heating zone (6) of the heating element projects outwards and defines an angle with the longitudinal axis of the cassette (9); in that the furnace insulation (4) includes for each cassette a hole (12) which is larger at its outer end than at its inner end, therewith enabling the cassette (9) to be rotated in a vertical plane as the heating zone (6) of the element (2) is inserted through the hole (12) and into said operating position parallel with the furnace wall; and in that a wedge-like body (13) is provided, whose shape corresponds to the shape of the empty space created by the shape of the hole (12) and located between the hole (12) and the cassette (9) when the cassette is placed in operating position in the hole, said body (13) being placed in said empty space during operation.

11 Claims, 2 Drawing Sheets

ARRANGEMENT FOR FASTENING HEATING ELEMENTS TO A FURNACE

BACKGROUND OF THE INVENTION

1. Field of the Invention

The present invention relates to an arrangement for mounting an electric heating element in a furnace.

2. Description of the Related Art

Electrically heated furnaces or ovens that include a process tube in which objects are heated are known to the art. Furnace insulation comprised of high grade brick, such as aluminum oxide brick, is provided externally of the process tube and in spaced relationship therewith. Such a furnace, or oven, will normally have a generally circular cross-section and will typically operate at a temperature of around 1700° C.

The heating elements used are placed equidistantly around the furnace, and heating zones are positioned in the space defined between the outer surface of the process tube and the inner surface of the brick insulation. The contacts of the elements are placed outside the brick insulation, i.e., externally of the furnace. The electrical conductors of the elements extend through holes in the brick insulation.

The aforesaid space has a narrow dimension in the radial direction of the furnace and, hence, the heating zone of the elements is disposed parallel with the outer surface of the process tube. The length of the heating zone is significantly greater than the width of said space.

A serious problem with this solution is that the elements cannot be replaced from outside the furnace. It is therefore necessary to first cool down the furnace and then remove the process tube, in order to be able to reach and to exchange the elements. The elements are therewith removed by withdrawing them inwardly into the furnace. It will be obvious from this that the exchange of the elements is both laborious and complicated.

This problem is solved by the present invention, which provides an arrangement by means of which the elements can be replaced from outside the furnace and without removing the process tube.

SUMMARY OF THE INVENTION

Accordingly, the present invention relates to an arrangement for mounting electric heating elements in a furnace in which objects are to be heated, wherein the furnace wall furnace insulation comprised of high grade brick. The heating zones of respective electric heating elements are placed vertically and parallel with the inner surface of the furnace wall in operation. The electrical leads or conductors of each heating element are mounted in a cassette and extend in channels provided therein, and the heating zone of respective heating elements project out and define an angle with the longitudinal axis of the cassette. The furnace insulation includes for each cassette a hole which is larger at its outer end than at its inner end, therewith enabling the cassette to be rotated in a vertical plane as the heating zone of the element is inserted through the hole and into said operating position parallel with the furnace wall. A wedge-like body is provided whose shape corresponds to the shape of the empty space created by the shape of the hole and is located between the hole and the cassette when the cassette is placed in operating position in the hole. The body is placed in the empty space during operation.

BRIEF DESCRIPTION OF THE DRAWINGS

The invention will now be described in more detail partly with reference to an exemplifying embodiment thereof illustrated in the accompanying drawings, in which:

FIG. 2 is a cross-sectional view of part of the furnace;

DESCRIPTION OF THE PREFERRED EMBODIMENTS

Figure 1:
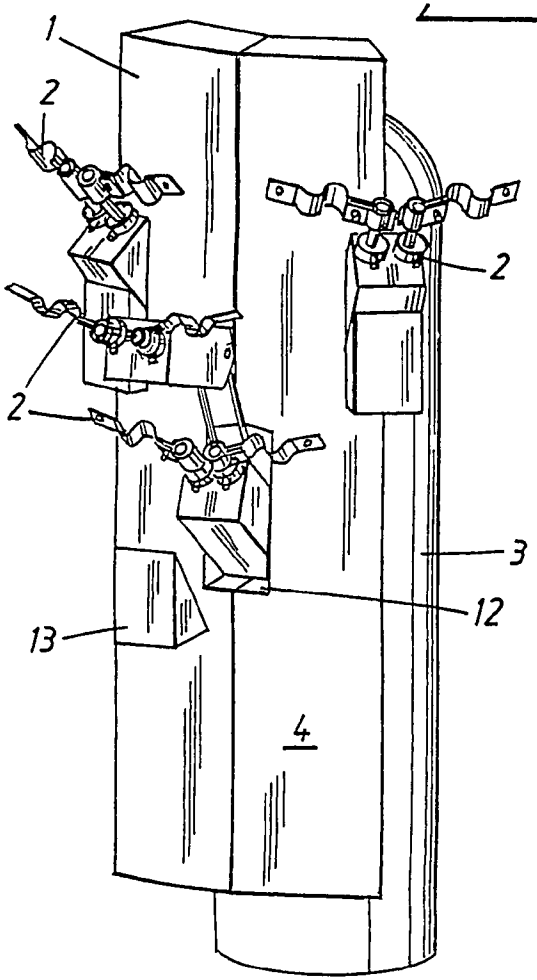
FIG. 1 is an outside view of part of a furnace equipped with heating elements.

FIG. 1 shows part of a furnace 1 equipped with heating elements 2. The type of furnace shown is one that includes a process tube 3 within which objects are intended to be heated.

Although the invention is described below with reference to a furnace that includes a process tube, it will be understood that the invention can be applied equally as well to a furnace without a process tube.

Located externally of the process tube 3 and in spaced relationship therewith is furnace insulation 4 comprised of high grade brick. The process tube 3 and the furnace insulation 4 are normally cylindrical and have their longitudinal axes placed vertically.

As will be seen from FIG. 2, a space 5 is defined between the process tube and the furnace insulation. As will also be seen from FIG. 2, the heating zones 6 of respective electrical heating elements 2 are located within said space 5 vertically and parallel with the inner surface of the furnace wall, in operation. The heating elements must hang vertically during operation, because of the high temperatures involved.

The aforesaid space is only slightly wider than said heating zones.

Figure 3:
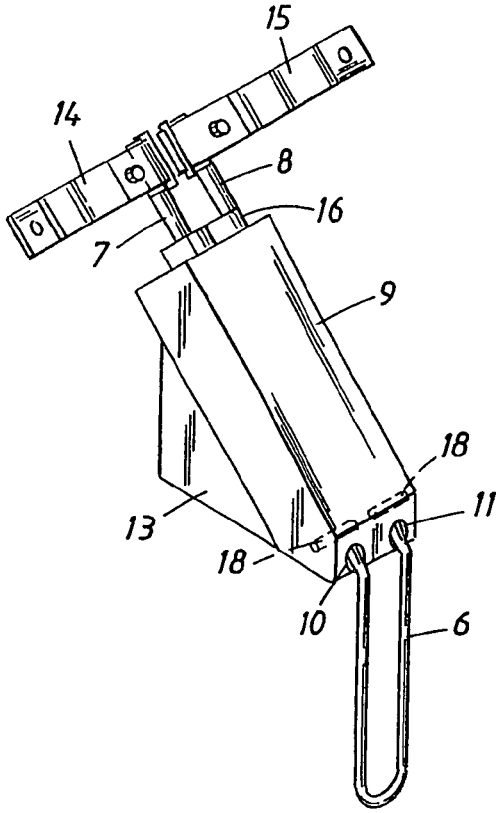
FIG. 3 is a perspective view of a heating element cassette.
Figure 4:
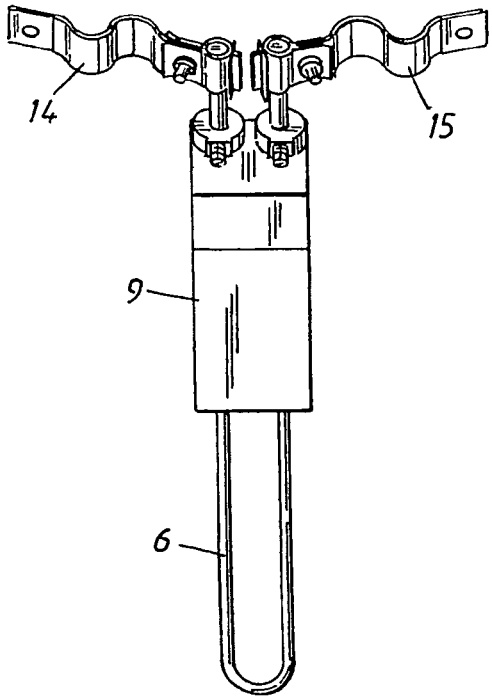
FIG. 4 is a head-on view of the heating element cassette.
Figure 5:
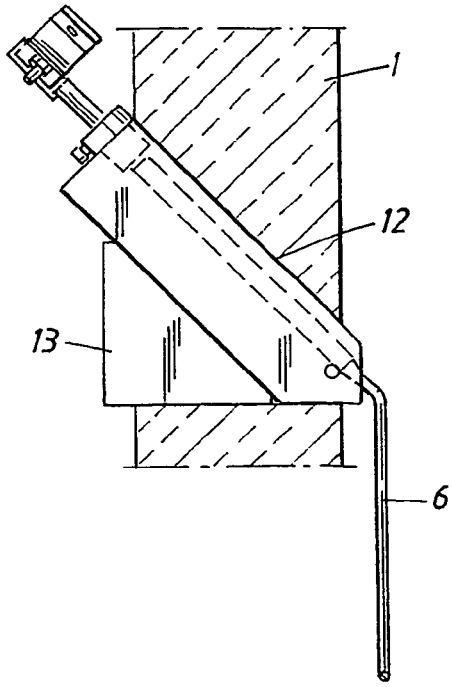

According to the invention, the electric leads, or conductors, 7, 8 of each heating element 2 are mounted in a cassette 9 and extend in channels 10, 11 therein, as shown in FIG. 3. The heating zones 6 of respective heating elements project out and define an angle with the longitudinal axis of the cassette 9.

The channels may have the form of cylindrical holes or may be upwardly open, as in FIG. 3. The elements suitably rest in the channels on ceramic supports 18, to prevent the elements sticking to the cassettes.

The elements are of a suitable kind and are supplied by the Applicants of this Patent.

As shown in FIG. 1, the furnace insulation 4 includes a hole 12 for each cassette 9. The hole 12 is larger at its outer end than at its inner end. This enables the cassette 9 to be rotated in the vertical plane as the heating zone 6 is inserted through the hole 12 and into the operating position parallel with the process tube 3. This is illustrated in FIG. 2, where the cassette, referenced 9*a*, is moved to a position 9*b* and finally to a position 9*c*. For the sake of clarity, the position 9*c* is illustrated by an overlying cassette.

Figure 5:
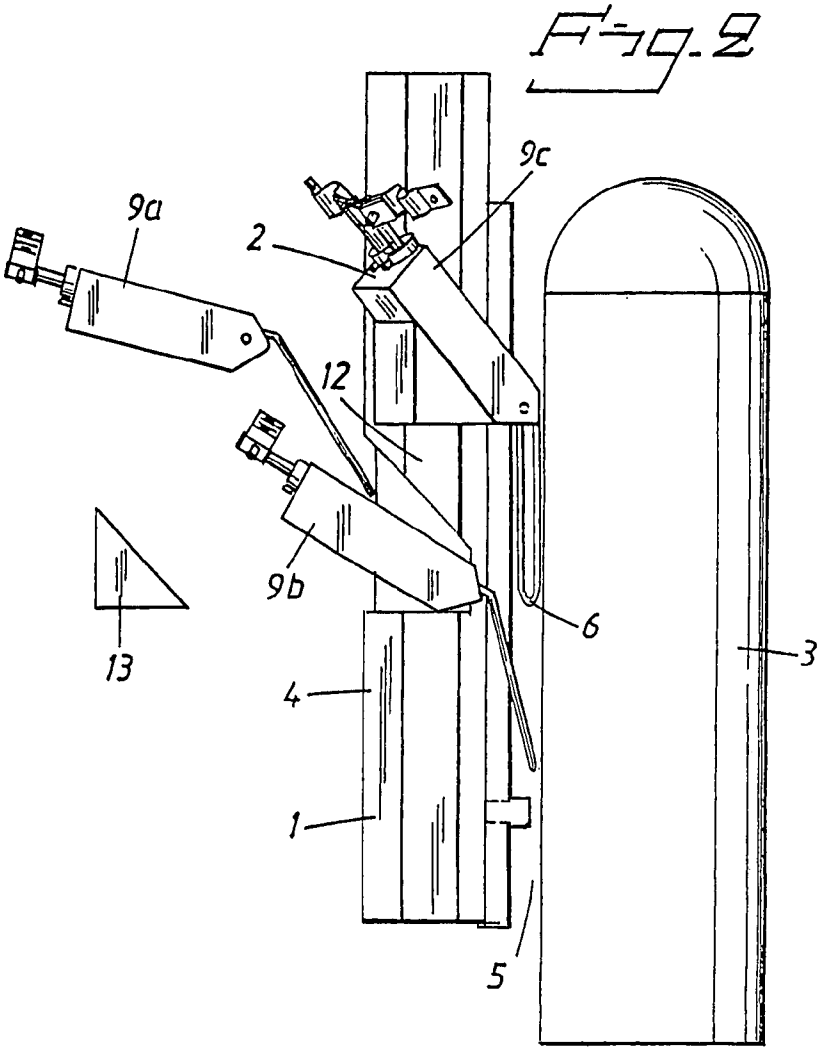
FIG. 5 is a cross-sectional view of the heating element cassette taken from one side.

The arrangement also includes a wedge-like body 13 whose shape corresponds to the shape of the empty space created by the shape of the hole 12 and located between the hole 12 and the cassette 9 when the cassette is placed in its operating position in said hole. As will be best seen from FIG. 5, the body 13 is placed in said empty space during operation.

An element is removed by first removing the wedge-shaped body and then the cassette. In this case, the cassette has the design shown in FIG. 3. The contact shoes 14, 15 of the element are loosened, the element holder 16 is removed and the element is taken away by moving it obliquely downwards as viewed in FIG. 3.

A new element can then be fitted in the reverse order of the above steps.

Thus, it is possible to remove and to fit elements as the furnace is in operation, which affords a significant advantage over known techniques.

According to one preferred embodiment of the invention, the element is at an angle of between 30 and 60 degrees, although said angle may, of course, be adapted to the design of the hole and to the width of the space 5 between the process tube and the insulation 4, so that the element can be inserted and withdrawn in the aforesaid manner.

According to one preferred embodiment, each cassette 9 is elongate and has a generally rectangular cross-section.

It is preferred that the furnace insulation 4 and the cassettes 9 are made from high grade brick, such as from aluminum oxide brick.

It is also preferred that the body 13 is made from high grade brick, such as aluminum oxide brick.

The aforesaid hole will preferably have a generally rectangular cross-section.

It is also preferred that the hole 12 has a horizontal undersurface, parallel vertical side edges and an upper side that defines an angle with the horizontal plane.

In case of such a design of the hole, it is preferred that the cassette 9 will abut the upper side of the hole 12 when in its operating position.

Assuming that the cassette 9 has the same width as the hole 12 and that the cassette 9 abuts the upper side of said hole when fitted, a wedge shaped open space will be formed beneath the cassette 9, as shown in FIG. 1 at the hole 12. In this case, the body 13 is shaped to fit in the wedge shaped space. Assembly is thus terminated by pushing the body in beneath the cassette. As a result, the furnace insulation is sealed essentially against heat leakage at the heating elements.

It will be obvious that the present invention solves the problem mentioned in the introduction.

It will also be obvious that the invention can be varied with regard to the design of the cassettes, the configuration of the holes and said body without departing from the function of achieving a seal essentially against the leakage of heat at said elements.

The present invention shall not therefore be considered as restricted to the embodiments indicated above, since variations and modifications can be made within the scope of the accompanying claims.

What is claimed is:

1. An arrangement for fastening electric heating elements in a furnace in which objects are to be heated, wherein the furnace wall includes a layer of furnace insulation, and wherein heating zones of respective electrical heating elements are positioned substantially vertically and parallel with an inner surface of the furnace wall, said arrangement comprising: a heating element cassette including channels for receiving electric leads of a heating element having a heating zone that projects out from and defines an angle with a longitudinal axis of the cassette; the furnace insulation including for each cassette a hole which is larger at its outer end than at its inner end to enable the cassette to be rotated in a vertical plane as the heating zone of the element is inserted through the hole and into an operating position substantially parallel with the furnace wall; and a wedge body having a shape that corresponds to the shape of an empty space created by the shape of the hole and located between the hole and the cassette when the cassette is placed in said operating position in the hole; wherein the body is located in said empty space during operation of the furnace.

2. An arrangement according to claim 1, wherein said angle is between about 30 and about 60 degrees.

3. An arrangement according to claim 1, wherein the cassette is elongate and has a generally rectangular cross-section.

4. An arrangement according to claim 1, wherein the furnace insulation and the cassettes are comprised of high grade brick.

5. An arrangement according to claim 4, wherein said body is comprised of high grade brick.

6. An arrangement according to claim 1, wherein said hole has a generally rectangular cross-section.

7. An arrangement according to claim 6, wherein the hole has a horizontal underside, parallel vertical side edges, and an upper side that defines an angle with a horizontal plane.

8. An arrangement according to claim 7, wherein the cassette is in abutment with the upper side of the hole when in an operating position; and wherein the body is inserted beneath the cassette.

9. An arrangement according to claim 1, wherein the furnace includes a process tube in which objects are heated, wherein a space is formed between the process tube and the furnace insulation, and wherein the heating zones of respective electrical heating elements are located in said space substantially parallel with the outer surface of the tube during operation of the furnace.

10. An arrangement according to claim 4, wherein the brick is aluminum oxide brick.

11. An arrangement according to claim 5, wherein the brick is aluminum oxide brick.

* * * * *